US008505550B2

(12) United States Patent
Velazquez

(10) Patent No.: US 8,505,550 B2
(45) Date of Patent: Aug. 13, 2013

(54) HAIR GROOMING TOOL

(76) Inventor: Vladimir Velazquez, North Miami Beach, FL (US)

( * ) Notice: Subject to any disclaimer, the term of this patent is extended or adjusted under 35 U.S.C. 154(b) by 0 days.

(21) Appl. No.: 13/463,679

(22) Filed: May 3, 2012

(65) Prior Publication Data

US 2013/0000664 A1 Jan. 3, 2013

Related U.S. Application Data

(63) Continuation of application No. 13/175,808, filed on Jul. 1, 2011, and a continuation of application No. 13/273,411, filed on Oct. 14, 2011.

(51) Int. Cl.
*A45D 24/10* (2006.01)

(52) U.S. Cl.
USPC ..... 132/148; 132/331; 2/160; 362/103; 362/115

(58) Field of Classification Search
USPC ..... 132/212, 213, 213.1, 330–333, 148, 132/150, 270, 73.5, 321, 288; 2/160, 161.1, 2/161.6, 163, 21; 362/103, 119, 120, 115, 362/259; 30/526, 297, 298; 602/21, 22; 128/879, 880; D28/10, 31, 73
IPC ..... A41D 19/00; A63B 71/14
See application file for complete search history.

(56) References Cited

U.S. PATENT DOCUMENTS

| | | | | | |
|---|---|---|---|---|---|
| 277,173 | A | * | 5/1883 | Thompson | 119/612 |
| 2,154,336 | A | * | 4/1939 | King | 132/139 |
| 2,199,282 | A | * | 4/1940 | Condron et al. | 132/149 |
| 2,467,975 | A | * | 4/1949 | Hollen | 132/149 |
| 2,954,832 | A | * | 10/1960 | Pirone | 172/370 |
| 3,145,718 | A | * | 8/1964 | Pigo | 132/148 |
| 3,417,840 | A | * | 12/1968 | Farnsworth, Jr. | 182/8 |
| 3,638,011 | A | * | 1/1972 | Bain et al. | 362/103 |
| 3,981,526 | A | * | 9/1976 | Lundqvist | 294/25 |
| D270,296 | S | | 8/1983 | Thomas | |
| D282,293 | S | | 1/1986 | Harvey | |
| 4,625,339 | A | * | 12/1986 | Peters | 2/160 |
| 4,899,916 | A | * | 2/1990 | Townsend | 223/101 |
| 5,042,512 | A | | 8/1991 | Knight | |
| 5,124,892 | A | * | 6/1992 | Lambert | 362/103 |
| 5,283,722 | A | * | 2/1994 | Koenen et al. | 362/570 |
| 5,293,661 | A | | 3/1994 | Appleby | |
| 5,499,637 | A | | 3/1996 | Foti | |
| D368,981 | S | | 4/1996 | Bozak | |
| 5,533,537 | A | | 7/1996 | Mourad | |
| 5,535,105 | A | * | 7/1996 | Koenen et al. | 362/570 |
| 5,644,796 | A | * | 7/1997 | Laughlin | 2/161.6 |
| 5,803,322 | A | * | 9/1998 | Boone et al. | 223/101 |
| 5,887,283 | A | * | 3/1999 | Mackay | 2/161.6 |
| 6,029,356 | A | * | 2/2000 | Sprinkle | 30/298 |
| 6,109,273 | A | | 8/2000 | Schleicher | |
| 6,240,928 | B1 | | 6/2001 | DaSilva | |
| 7,000,258 | B1 | * | 2/2006 | Nunally | 2/160 |
| 7,231,925 | B1 | | 6/2007 | Wall | |
| 7,421,787 | B2 | * | 9/2008 | White et al. | 30/123 |

(Continued)

*Primary Examiner* — Robyn Doan
*Assistant Examiner* — Tatiana Nobrega
(74) *Attorney, Agent, or Firm* — Ruben Alcoba Esq

(57) ABSTRACT

A hair grooming tool that is comprised of a housing having a pick extending therefrom and a light source cartridge housed therein. The housing is attached to a finger hair stabilizer. A user inserts one of his or her fingers in the finger hair stabilizer when the hair grooming tool is used.

4 Claims, 6 Drawing Sheets

(56) References Cited

U.S. PATENT DOCUMENTS

| | | | | |
|---|---|---|---|---|
| 7,743,690 | B2 * | 6/2010 | White et al. | 83/13 |
| 8,038,310 | B1 * | 10/2011 | Hale et al. | 362/103 |
| D648,072 | S * | 11/2011 | Freeman | D28/31 |
| 2007/0058362 | A1 * | 3/2007 | Winfrey | 362/103 |
| 2008/0062676 | A1 * | 3/2008 | Masuda | 362/103 |
| 2009/0168407 | A1 * | 7/2009 | Wright | 362/103 |

* cited by examiner

HAIR GROOMING TOOL

CROSS-REFERENCE

This applications is a continuation of application Ser. Nos. 13/175,808 and 13/273,411 filed on 1 Jul. 2011 and 14 Oct. 2011, entitled Multi-Task Hair Grooming pick and Ninja Pick, respectively, by Vladimir Velasquez. All of these applications are incorporated herein by this reference.

FIELD OF THE INVENTION

The present invention relates to a hair grooming apparatus particularly used as a complimentary apparatus for hair combing, hair blow drying, hair weaving, hair partitioning, hair lifting, hair braiding, hair highlighting, hair coloring, and other hair manipulation processes or as a combination apparatus for some of the aforementioned processes.

BACKGROUND

There are several state of the art hair grooming devices known in the prior art that are preferably used to facilitate hair titling and hair combing of sectioned hair strands. Time after time, these devices managed to eliminate any unwanted tangling and matting of hair strands. Furthermore, there are other hair grooming devices known in the prior art that are used as multi-purpose apparatuses for purposes of hair combing and hair picking: Harvey, U.S. Pat. No. D282,293; Wall, U.S. Pat. No. 7,231,925; and Schleicher, U.S. Pat. No. 6,109,273.

There are other hair grooming devices known in the prior art that are used predominantly for the purpose of hair lifting only: Thomas, U.S. Pat. No. D270,296; Bozak, U.S. Pat. No. D368,981; and Featherstone, and U.S. Pat. No. 258,541.

There are few others that serve the purpose of replaceable brush holders with various orientations therein, see U.S. Pat. No. 5,293,661.

Finally, there are hair grooming devices known in the prior art that function as applicator tools for processes of hair dressing, hair coloring and the like. See Knight, U.S. Pat. No. 5,042,512; Foti, U.S. Pat. No. 5,499,637; Mourad, U.S. Pat. No. 5,533,537; DaSilva, U.S. Pat. No. 6,240,928.

However, none of the devices aforementioned provide an all-inclusive, multi-functional hair grooming apparatus that can seamlessly manipulate various processes of hair grooming with just one hand. Most of the devices known in the prior art require the use of a second hand as an assistant to hold the hair strands while the first hand performs the various hair grooming processes. The cumbersome procedure is a drastic disadvantage for a user who seems disabled when engaged in a combined effort of hair grooming process, where simultaneous actions are essential. For example, combination processes such as hair lifting and hair highlighting or hair combing and hair partitioning. Additionally, the present invention alleviates many hair grooming disadvantages and rewards a user with a revolutionary hair grooming tool that can be worn on one hand manipulated through movement of that one hand, thus leaving the other hand to perform other relevant tasks essential in making the hair grooming experience a seamless process. The present invention allows the user to save time due to its combined state of the art, multi-tasking functionality in hair grooming.

For the foregoing reasons, there is a need of a hair grooming device that is all-inclusive and versatile, and one which can enable anyone to perform various hair grooming processes with great flexibility and lesser disadvantages. The present invention is a multi-task hair grooming pick that is easily maneuverable, easily transportable, lightweight, and inexpensive to manufacture.

SUMMARY

The present invention is directed to a multi task hair grooming pick that ensures a user to separate, flip and articulate hair while simultaneously performing various hair grooming tasks with ease. The present invention is water resistant, detachable and is accommodated to fit the sizes and dexterity of anyone in all assortments.

The present invention is a hair grooming pick that manipulates hair in numerous ways, while simultaneously providing a means for attaching any accessory for aiding in the hair grooming process.

The present invention is a hair grooming pick that performs a myriad of hair grooming procedures, such as combing, parting, flipping, braiding, separating, or any other creative manipulation of hair. The hair grooming pick is effective in providing a tightly controlled, efficient manipulation of hair because it is attached to a glove worn by the user. The tight glove gives the use a feeling of complete control of the hair pick. Thus, while wearing the device, any small movement of the wrist or fingers translates into precise manipulation of the hair. The hair grooming device also provides illumination from an attachable light source. This is useful for grooming hair in poorly lit areas. However, since the light source is detachable, it can be used for a plethora of different illumination functions beyond the scope of hair grooming.

The present invention is a hair grooming tool that is comprised of a housing that houses a light source cartridge. The housing is attached to a finger hair stabilizer. A user inserts one of his or her fingers in the pick hair stabilizer when the hair grooming tool is used.

An object of the present invention is to provide a hair grooming device that gives the user a precision control feeling when using the tool.

A further object of the present invention is to allow a user of the device to handle the hair in a seamless an efficient manner.

DRAWINGS

These and other features, aspects and advantages of the present invention will become better understood with regard to the following description, appended claims and drawings where:

DESCRIPTION

Figure 1:
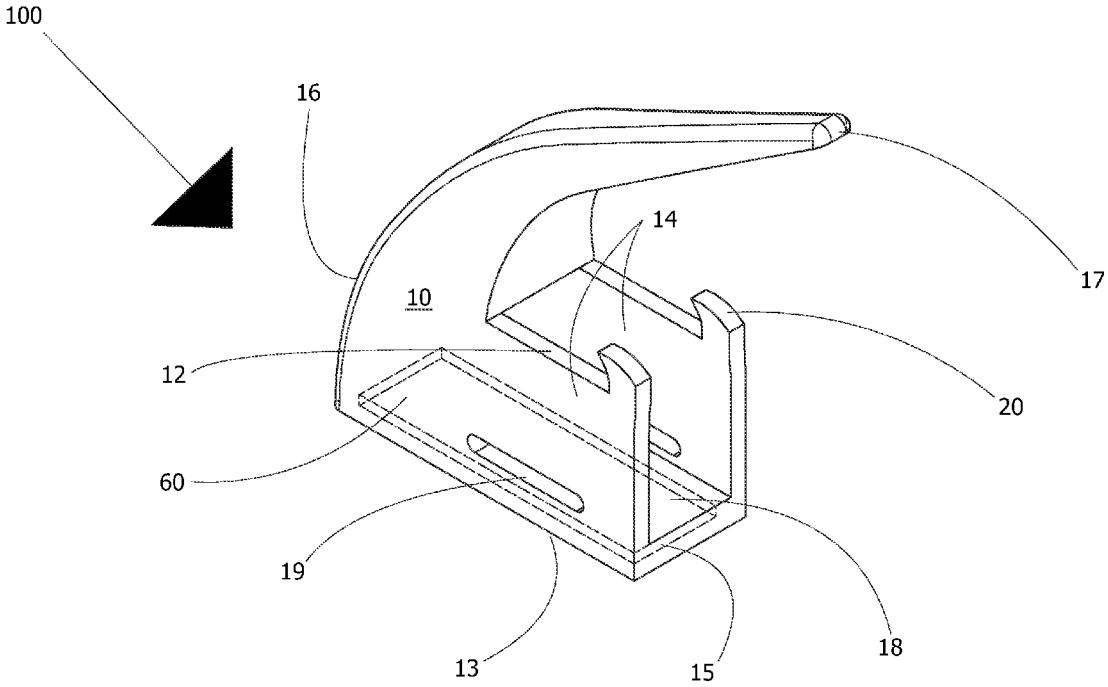
FIG. 1 is a perspective view of the housing of the present invention.
Figure 2:
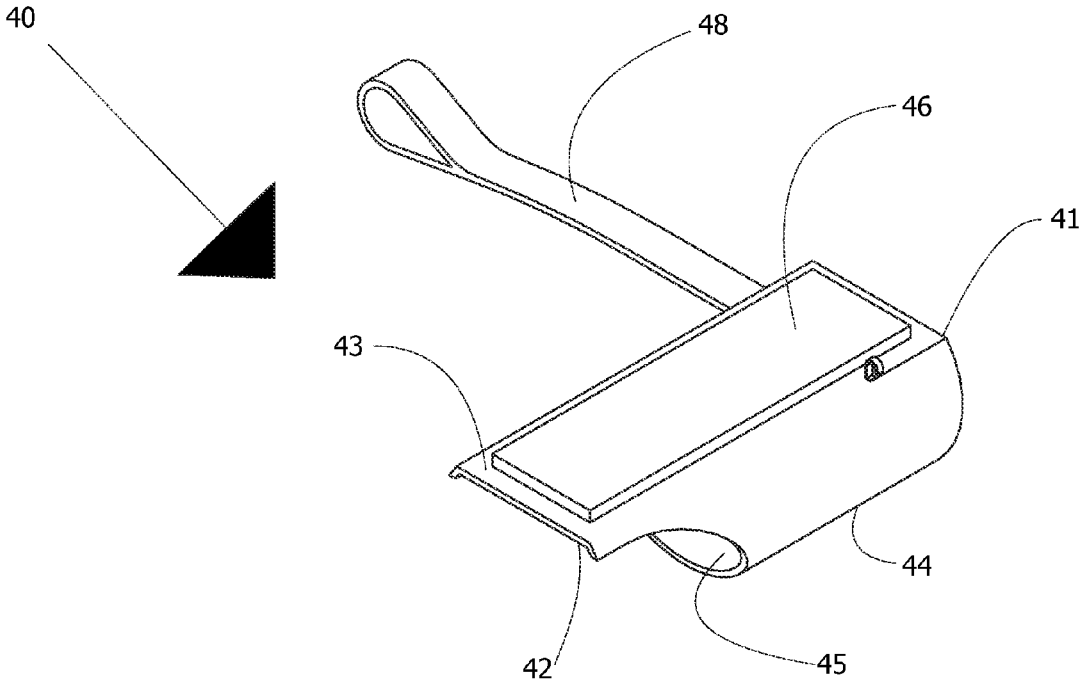
FIG. 2 is a perspective view of the finger hair stabilizer of the present invention.
Figure 3:
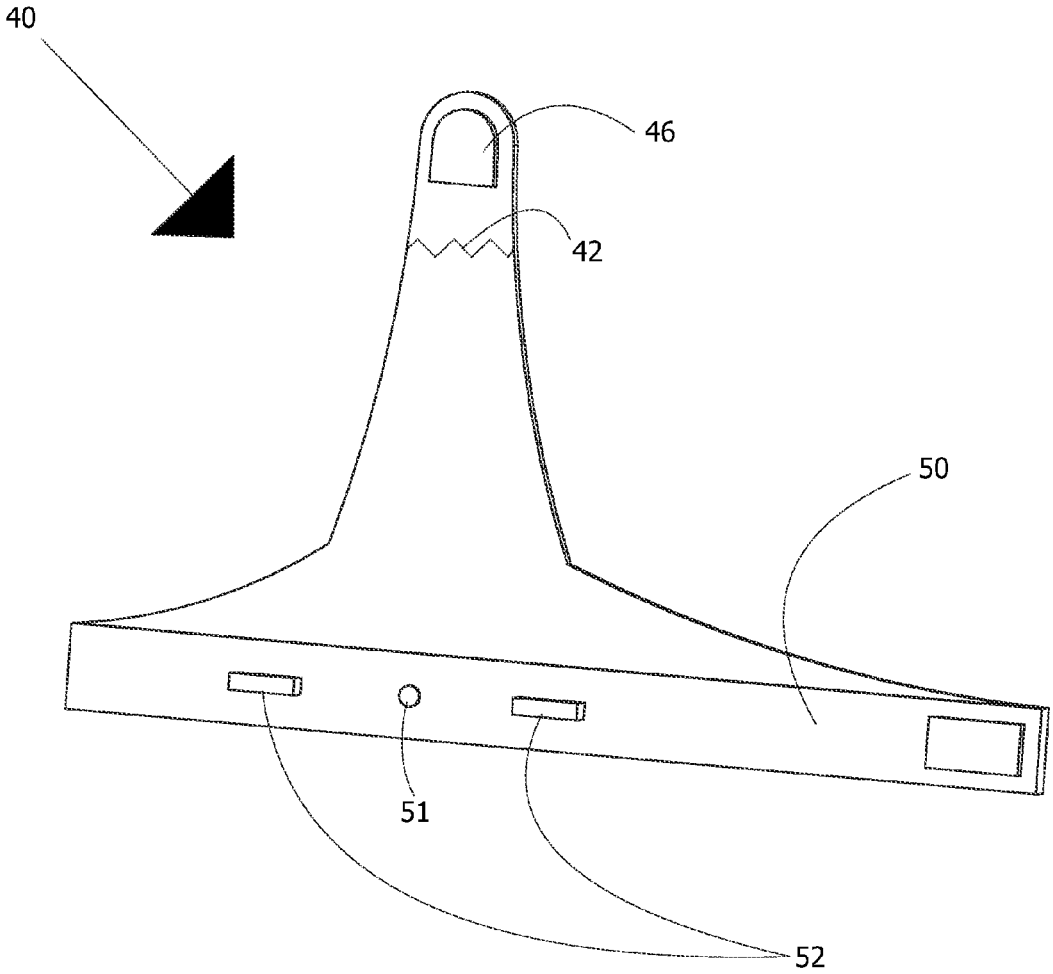
FIG. 3 is a top plan view of the finger hair stabilizer.
Figure 4:
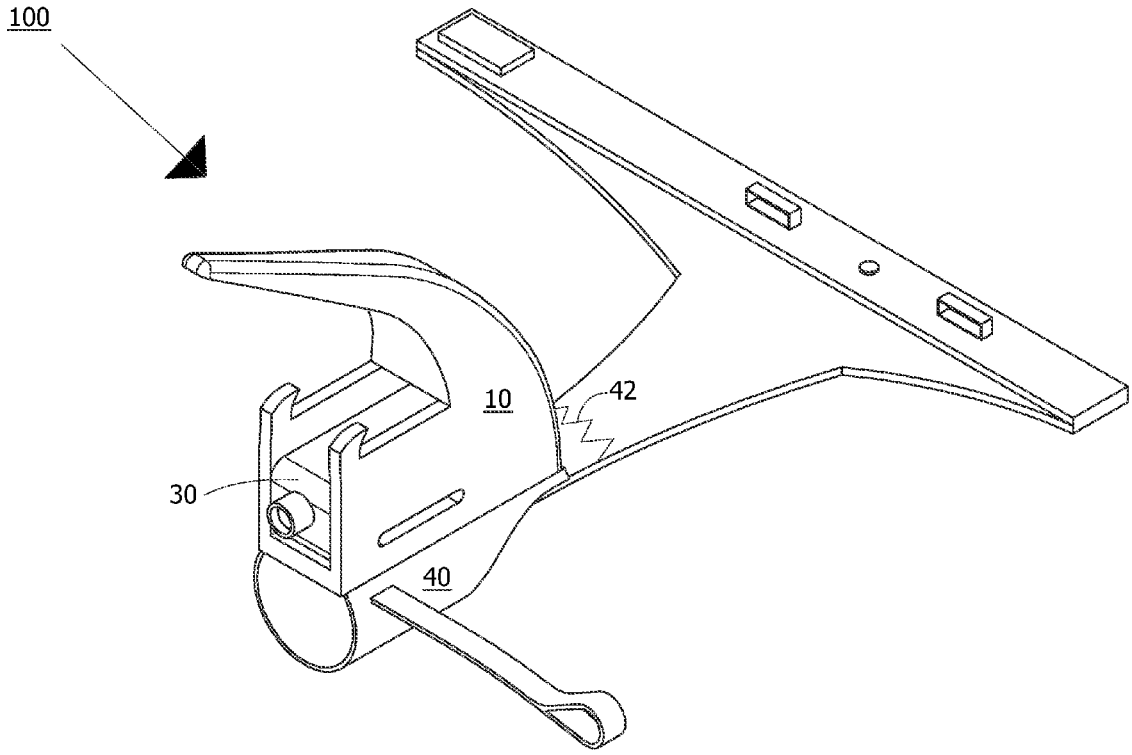
FIG. 4 is a perspective view of the hair grooming tool.
Figure 5:
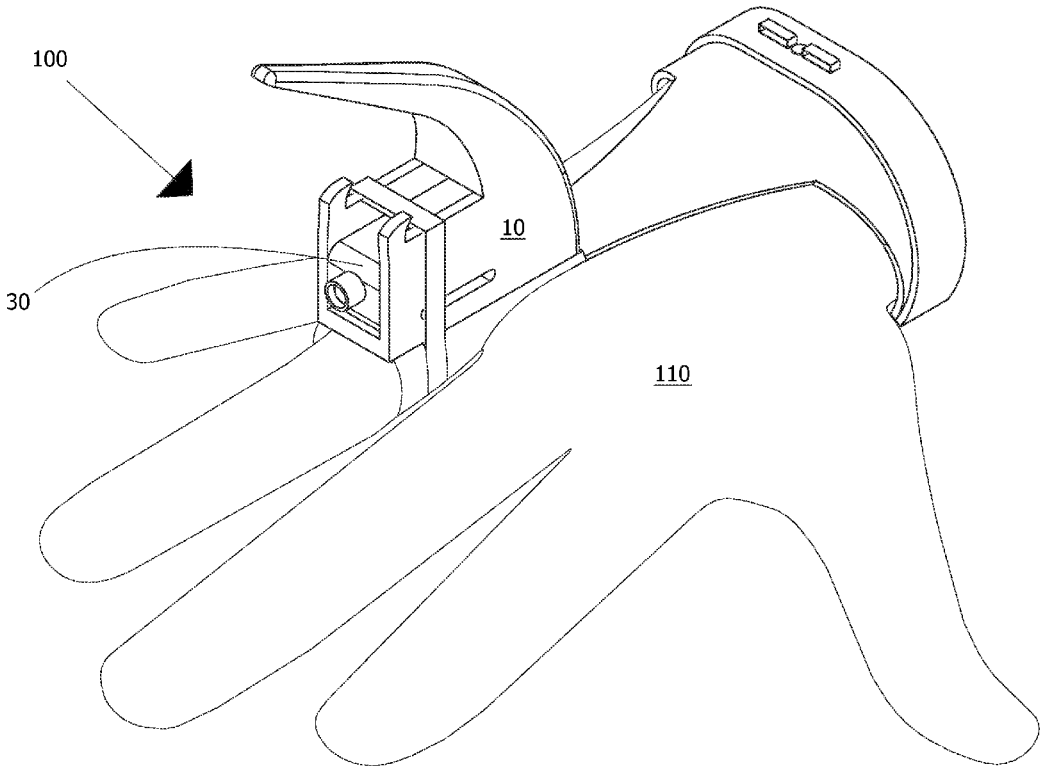
FIG. 5 is a perspective view of the hair grooming tool placed on the finger of a user.
Figure 6:
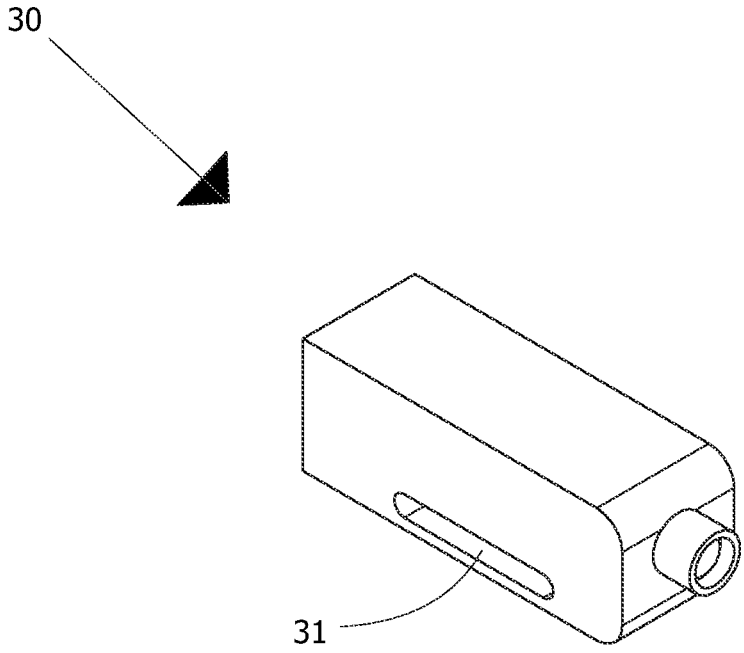
FIG. 6 is a perspective view of the light source of the present invention.

As seen in FIGS. 1-6, a hair grooming tool 100 for lifting strands of hair, the hair grooming tool 100 comprises a housing 10 wherein the housing has a top 12, a bottom 13, two sides 14, a front 15 and a rear 16, a pick 17 extends upward from the rear of the housing 10 toward the front 15 of the housing 10 at an angle than can range from about twenty degree to about thirty-five degree in relation to the bottom side 13 of the housing 10, the front of the housing 15 defines an aperture 18 between the two sides 14 of the housing 10 each side of the housing 14 defines two aperture slots 19 that are parallel to each other, each side wall 14 further defines a hook 20 at a position that is adjacent to the front 15 of the housing where the hooks curve toward the rear 16 of the housing, a first hook and loop attachment 60 attached to the bottom 13 of the housing 10; As seen in FIG. 6, a light source cartridge 30, the light source cartridge 30 is removably housed within the housing 10, the light source cartridge 30 defines a pair of light source slots 31 that line up with the aperture slots 19 of the picked shaped housing 10 when the light source cartridge 30 is housed within the housing 10; and as seen in FIGS. 2 and 4, a finger hair stabilizer 40 that is worn on the hand of a human, the finger hair stabilizer 40 has a front 41, a rear 42, a top 43 and a bottom 44 section, the bottom of the front section 44 defines a finger holder 45, a second hook and loop attachment 46 attached to the top of the front section 43 of the finger hair stabilizer 40, and a band 48 that is attached to the finger hair stabilizer 45. When a user uses the present invention, he or she would secure the housing 10 on the finger hair stabilizer 40 by using the housing 19 and light source aperture 31 slots.

The light source is used to detect the condition of the hair and its surrounding and to provide the user more light with regards to the hair being treated.

In another embodiment of the present invention, As seen in FIGS. 3, 4 and 5 the hair grooming tool's 100 finger hair stabilizer's rear section defines a wrist hand 50 that secures around the wrist of a user. The wrist band 50 pulls the finger hair stabilizer 40 toward the wrist of the user, thereby further strengthening the stabilization of the hair grooming tool 100 when worn by the user. The wrist band 50 may be made of an elastic polyester-nylon fabric or any other similar material that is stretchable and breathable.

In a further embodiment of the present invention, as seen in FIG. 3, the wrist band 50 further comprises of a magnetic element 51 that is positioned on the top of the finger hair stabilizer 40. The magnetic element 51 is used to attach bobby pins to the hair grooming tools 100. In still a further embodiment of the present invention, the wrist band 50 might define at least one pocket 52. The pockets 52 are for securing scissors, hair clips, chopsticks, and bobby pins to the hair grooming tool.

An advantage of the present invention is that it provides a hair grooming device 100 that gives the user a precision control feeling when the tool is used.

A further advantage of the present invention is that it allows a user of a hair grooming device 100 to handle hair in a seamless an efficient manner.

Although the present invention has been described in considerable detail in reference to preferred versions, other versions are possible. Therefore, the spirit and scope of the appended claims should not be limited to the description of the referred versions contained herein.

What is claimed is:

1. A hair grooming tool for lifting strands of hair, the hair grooming tool comprises:

a housing having a top, a bottom, two sides, a front and rear, a pick extends upward form the rear of the housing toward the front of the housing at an angle than can range from about twenty degree to about thirty-five degree in relation to the bottom side of the housing, the front of the housing defines an aperture between the two sides of the housing, each side of the housing defines two aperture slots that are parallel to each other, each side wall further defines a hook at a position that is adjacent to the front of the housing where the hooks curve toward the rear of the housing, a first hook and loop attachment attached to the bottom of the housing;

a light source cartridge inserted within the housing, the light source cartridge defines light source slots that will line up with the aperture slots of the housing when the light source cartridge is housed within the housing; and a finger hair stabilizer that is worn on the hand of a human, the stabilizer has a front, a rear, a top and a bottom section, the bottom of the front section defines a finger holder, a second hook and loop attachment attached to the top of the front section of the finger hair stabilizer, and a band that is attached to the finger holder, the top section of the finger hair stabilizer attaches to the bottom of the pick shaped housing.

2. The hair grooming tool of claim 1, wherein the finger hair stabilizer's rear section defines a wrist band that secures around the wrist of a user.

3. The hair grooming tool of claim 2, wherein the wrist band further comprises of a magnetic element that is positioned on the top of the finger hair stabilizer.

4. The hair grooming tool of claim 3, wherein the wrist band defines at least one pocket.

* * * * *